US008464915B2

(12) United States Patent
Rovelli

(10) Patent No.: US 8,464,915 B2
(45) Date of Patent: Jun. 18, 2013

(54) DISPENSING CAP WITH AUTOMATIC VALVE FOR CONTAINERS FOR TRANSPORTING AND DISPENSING LIQUID OR CREAMY SUBSTANCES

(75) Inventor: Ivan Maria Rovelli, Monza (IT)

(73) Assignee: Capsol S.p.A., Bulciago (LC) (IT)

( * ) Notice: Subject to any disclaimer, the term of this patent is extended or adjusted under 35 U.S.C. 154(b) by 91 days.

(21) Appl. No.: 13/176,611

(22) Filed: Jul. 5, 2011

(65) Prior Publication Data

US 2012/0006861 A1 Jan. 12, 2012

(30) Foreign Application Priority Data

Jul. 6, 2010 (IT) ..... MI2010A1243

(51) Int. Cl.
*B65D 25/40* (2006.01)

(52) U.S. Cl.
USPC .. 222/494; 222/546; 220/203.01; 220/203.28

(58) Field of Classification Search
USPC ..... 215/260; 220/203.01, 203.11, 203.16, 220/203.19, 203.28; 222/490, 491, 494, 546
See application file for complete search history.

(56) References Cited

U.S. PATENT DOCUMENTS

| | | | | |
|---|---|---|---|---|
| 1,607,993 | A * | 11/1926 | Loewy | 222/490 |
| 3,685,701 | A | 8/1972 | Kollus | |
| 3,964,509 | A * | 6/1976 | Daubenberger et al. | 137/844 |
| 4,620,648 | A * | 11/1986 | Schwartzman | 222/490 |
| 4,896,789 | A * | 1/1990 | Federspiel | 220/203.17 |
| 5,005,737 | A * | 4/1991 | Rohr | 222/212 |
| 5,271,531 | A * | 12/1993 | Rohr et al. | 222/212 |
| 6,095,381 | A * | 8/2000 | Schwanenberg | 222/490 |
| 6,223,956 | B1 * | 5/2001 | Albers | 222/494 |
| 6,364,145 | B1 * | 4/2002 | Shaw et al. | 220/203.11 |
| 6,726,063 | B2 * | 4/2004 | Stull et al. | 222/212 |
| 7,306,127 | B2 * | 12/2007 | Eimer | 222/494 |
| 7,500,585 | B2 * | 3/2009 | Masuda | 222/494 |
| 7,503,469 | B2 * | 3/2009 | Bloom et al. | 222/494 |
| 2002/0134801 | A1 * | 9/2002 | Stewart | 222/541.4 |
| 2003/0189067 | A1 * | 10/2003 | Stull et al. | 222/494 |
| 2010/0089921 | A1 | 4/2010 | Ellenkamp-Van Olst et al. | |

FOREIGN PATENT DOCUMENTS

| | | |
|---|---|---|
| EP | 0405472 A1 | 1/1991 |
| JP | 54039244 | 3/1979 |
| WO | 2009056792 A1 | 5/2009 |

OTHER PUBLICATIONS

EPO Search Report for Italian patent application No. MI2010A001243 dated Feb. 2, 2011.

* cited by examiner

*Primary Examiner* — Kevin P Shaver
*Assistant Examiner* — Patrick M Buechner
(74) *Attorney, Agent, or Firm* — Novak Druce Connolly Bove + Quigg LLP

(57) ABSTRACT

A dispensing cap with automatic valve for containers for transporting and dispensing liquid or creamy substances, including ways for its sealed fixing to a container neck, and a dispensing port associated with the automatic valve, the valve containing a body formed of soft plastic material and provided with ways for its fixing to the cap, and at least one first and one second flexible flap able to assume a closed position, the first and the second flap being formed in at least two different planes, such that when the pressure inside the can equals the external pressure they assume a rest position in which a passage space is present between them to enable air to pass.

15 Claims, 3 Drawing Sheets

DISPENSING CAP WITH AUTOMATIC VALVE FOR CONTAINERS FOR TRANSPORTING AND DISPENSING LIQUID OR CREAMY SUBSTANCES

CROSS-REFERENCE TO RELATED APPLICATIONS

This application claims priority from Italian Application No. MI 2010A001243, filed on Jul. 6, 2010.

FIELD OF THE INVENTION

The present invention relates to a dispensing cap with automatic valve for containers for transporting and dispensing liquid or creamy substances.

It relates in particular to a cap associable with a flexible container.

Caps are currently known presenting a silicone insert located in proximity to a dispensing port of the cap.

BACKGROUND OF THE INVENTION

This silicone or thermoplastic rubber insert is produced by moulding. It comprises a top part of predetermined thickness in which a cross-shaped cut is made after moulding.

The cross-shaped cut creates four flaps which when frontally resting one against another hermetically close the container, whereas when a is pressure exceeding a certain threshold value is present in the container they flex outwards to hence free a dispensing port.

The drawback of this known art is that if the product to be dispensed contains sticky components, the front edges of the flaps can stick together and become difficult to open, necessarily requiring more pressure.

A further drawback of the known art is that when the flaps move into their closure position they frontally press against each other to form a hermetic seal which does not allow air to enter the container.

SUMMARY OF THE INVENTION

An object of the present invention is therefore to provide a cap which represents an improvement over the known art.

A further object of the present invention is to provide a cap in which the pressure required to open the valve is substantially constant and is not influenced by any product residues which remain on the valve.

These and other objects are attained by a cap in accordance with the technical teachings of the accompanying claims.

BRIEF DESCRIPTION OF THE DRAWINGS

Further characteristics and advantages of the invention will be apparent from the description of a preferred but non-exclusive embodiment of the invention, illustrated by way of no-limiting example in the accompanying drawings, in which.

DETAILED DESCRIPTION OF THE PREFERRED EMBODIMENTS

With reference to said figures, these show a dispensing cap 1 with automatic valve 2 for containers (not shown) able to transport and dispense liquid or creamy substances such as creams, shampoos, liquid soaps, balsams and the like.

Figure 8:
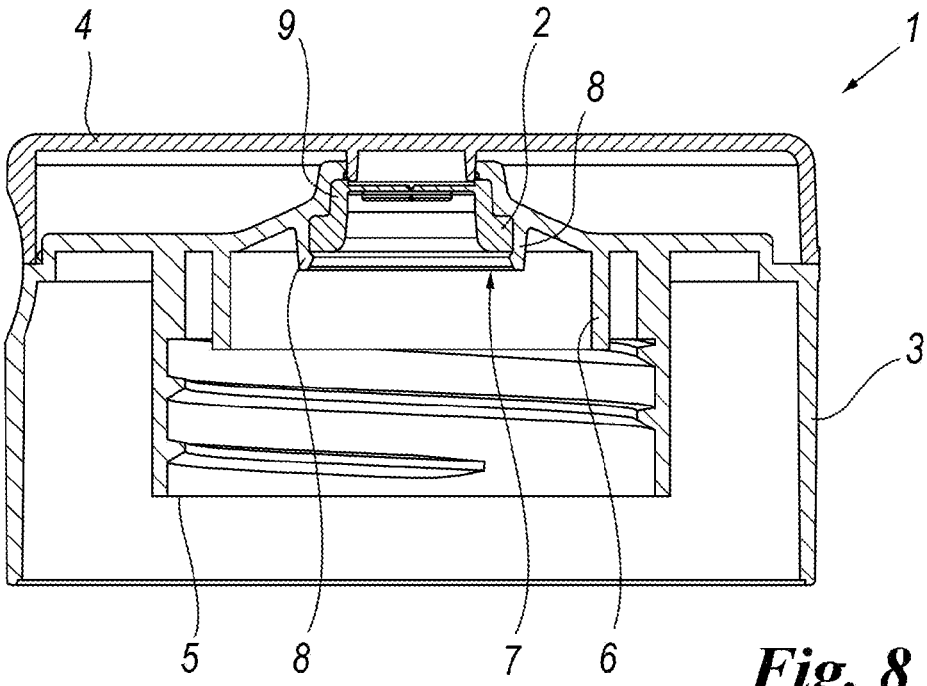
FIG. 8 is a section through the cap of the present invention.

The cap 1 (see FIG. 8) comprises a profiled body 3 and a cover 4 hinged together and formed in a single moulded piece. The profiled body 3 presents a threaded part representing a means for its fixing to the neck of a container for containing the substance to be dispensed. In proximity to the threaded part a projecting element 6 is present, which on insertion into the container neck forms a seal between the cap and container. The seal can also be provided in other ways, for example directly between the container and the valve to be described hereinafter.

The profiled body 3 comprises a seat 7 presenting undercut and snap-fixing means 8 which lock the valve 2 in a position corresponding with the dispensing port 9, this opening towards the outside of the cap.

The valve 2 presents a body formed of soft plastic material and is provided, for its fixing to the cap, with means substantially comprising a flange 2A which extends into the lower portion of the valve and connects to the snap-fixing means 8.

The material with which the valve is formed can be thermoplastic rubber, SEBS, LLDPE, silicone or any other material suitable for the purpose.

Figure 1:
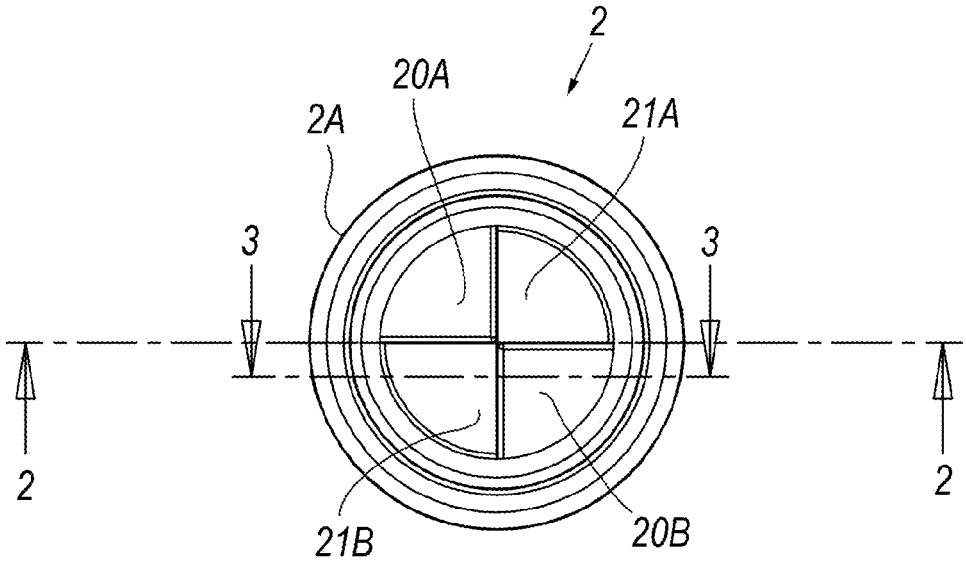
FIG. 1 is a top plan view of a valve of the cap according to the present invention.
Figure 2:
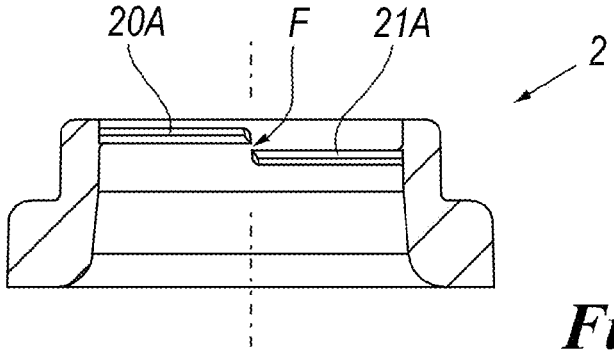
FIG. 2 is a section through the valve of FIG. 1 when in its rest position.

Extending from the valve body 2B there are two first flaps 20A, B and second flaps 21A, B. These flaps can be of any number, with a minimum of two, and can also be of odd number. The characteristic of the present invention is that the first and second flaps are positioned in different planes, as can be seen in FIG. 2, in which the valve is shown in a rest condition.

In the embodiment described here the flaps are four in number, namely two first flaps and two second flaps. Proceeding in a clockwise direction and starting from the first flap 20A, there is a second flap 21A, a further first flap 20B, and a further second flap 21B. The first and second flaps are of circular sector shape with an angle of 90° at the centre. They are mutually offset by 90° such as to completely close the dispensing aperture.

Figure 4:
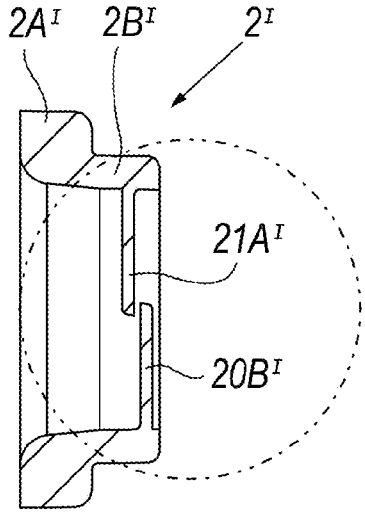
FIG. 4 is a section through a different embodiment of the valve of the present invention.
Figure 5:
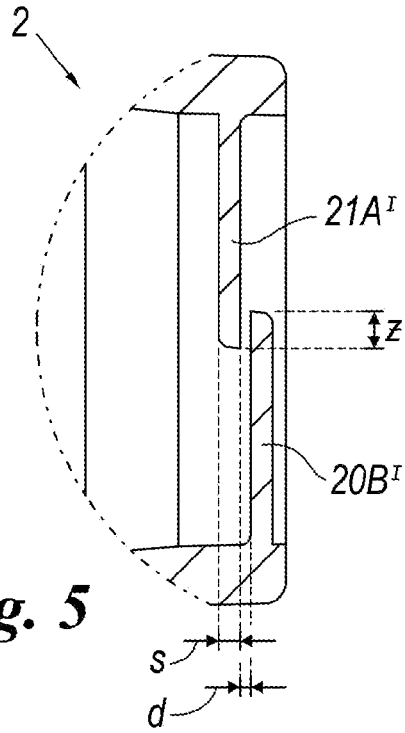
FIG. 5 is an enlargement of the region shown within the circle in FIG. 4.
Figure 6:
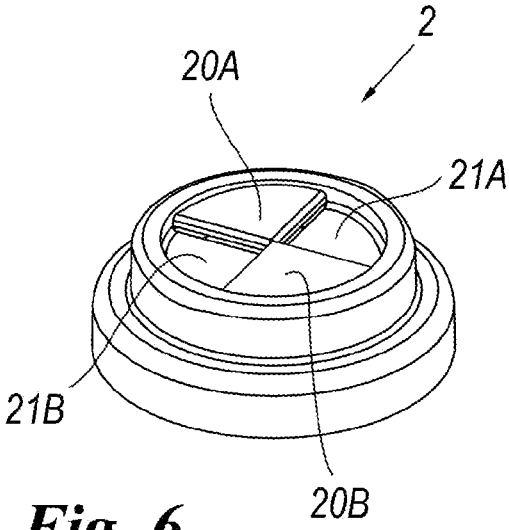
FIGS. 6 and 7 show two perspective views of the valve of FIG. 1.
Figure 7:
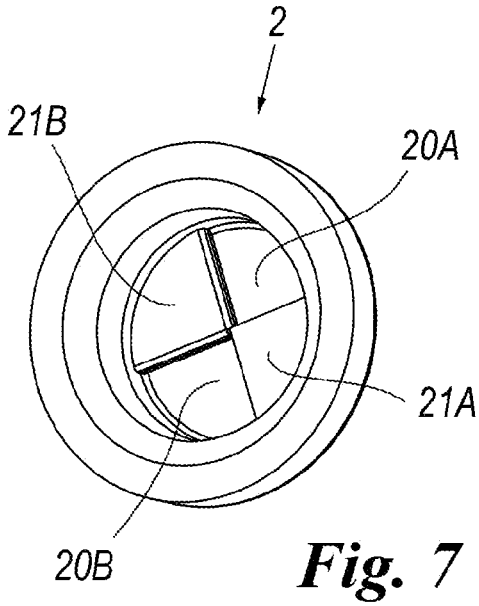

In alternative embodiments, they can have different shapes. Hence in the embodiment of the valve $\mathbf{2}^{I}$ of FIG. 4, comprising a flange $\mathbf{2}A^{I}$ and a valve body $\mathbf{2}B^{I}$, each flap ($\mathbf{21}A^{I}$, $\mathbf{20}B^{I}$ shown) presents a surface area slightly greater than that of a circular sector with an angle of 90° at its centre. In this manner, in proximity to the passage from one flap to the adjacent flap, these are slightly superposed. The superposed region Z (see FIG. 5) is between 0.05 and 1.5 mm, advantageously 0.2 mm.

If a different number of flaps are provided, the angle at the centre could evidently be greater or lesser. Given the flexibility of the system, the body 2B could have any sectional shape, including square, rectangular, triangular etc., there being also no limit on diameter.

Advantageously the flaps present a thickness S between 0.2 and 3 mm, preferably 0.4 mm.

During the various stages in the use of the valve, the flaps can present various positions by virtue of their flexibility and the flexibility of the material with which they are formed.

In particular they can assume a rest position, represented in FIG. 2, which occurs when the pressure in the container is equal to the external pressure. Under these conditions, at least one slit F is present between them, enabling air to pass. Alternatively, when in the rest position the lower surface of the first flap is substantially in contact with the upper surface of the second, but without forming a seal.

The upper flap can then flex, by virtue of its weight, until it touches the lower flap. In any event, and as stated, a hermetic seal under these conditions is not provided and is not possible.

In this respect, in all cases the flaps would simply rest on each other.

The configuration with flaps provided in two different planes is very advantageous. In fact, using this configuration, the valve and flaps can be formed directly by injection moulding, with flap pre-cutting achieved by vertical mould adjustment. In this manner, in contrast to traditional valves, a further cutting operation subsequent to moulding is not required, and the valve leaves the mould ready for location in the cap and already perfectly functional.

Advantageously when in the rest position (which substantially coincides with the valve having just left the mould) the lower surface of the first flap is spaced from the upper surface of the second flap by a distance d between 0.05 and 1.5 mm, preferably 0.15 mm.

Figure 2A:
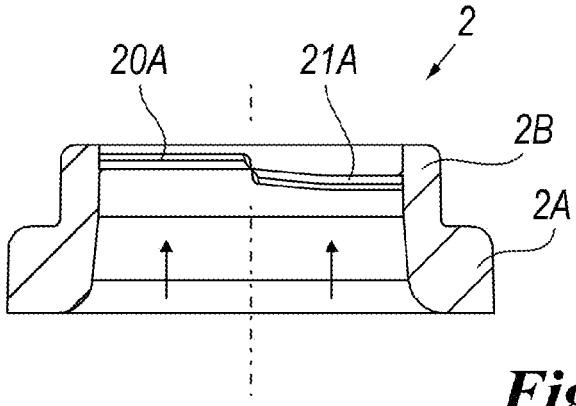
FIG. 2A is a section on the line 2-2 of the valve of FIG. 1 shown in a closed position.

When the pressure inside the container or acting on the valve (or rather on the flaps) is slightly greater than the external pressure, the flaps move into the configuration of FIG. 2A. This situation occurs for example when the container has been turned upside down, and hence the pressure of the liquid (given its weight) acts on the valve and closes it by flexing the lower flap. In this configuration the valve makes the necessary seal to prevent the liquid or creamy substance from emerging through the dispensing port.

Only a further pressure exerted on the container, to consequently cause an increase in the pressure acting on the valve, results in valve opening determined by the flexure of the flaps.

Essentially, when the valve is subjected to a pressure below a determined value, the flaps, by lying on or resting against each other, form a "seal" which prevents the substance inside the container from emerging. The seal made by the flaps is not an airtight seal, which as shown is not present, but instead a seal against the (dense) substance contained in the container.

The "determined value" of this pressure is a variable which can be set during valve design, by acting on the flap thicknesses S, on the amount of superposing Z between one and another, and on the type and rigidity of the material used to form the valve.

Figure 2B:
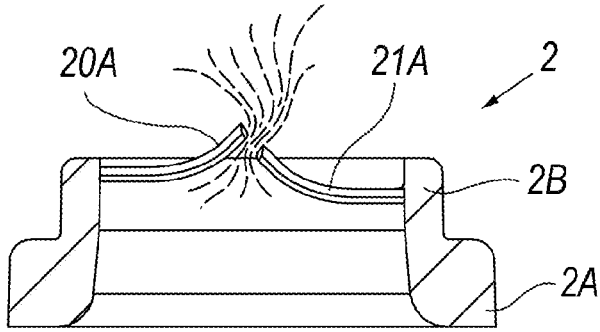
FIG. 2B is a section through the valve of FIG. 1 shown in an open position.
Figure 3:
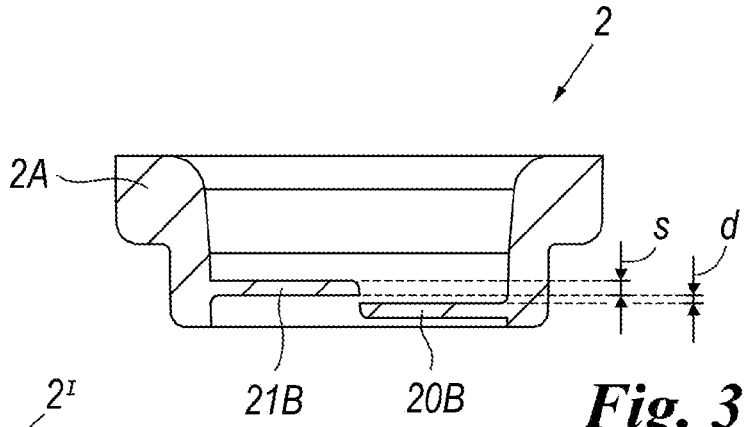
FIG. 3 is a section on the line 3-3 of FIG. 1.

When the pressure inside the container, which acts on the valve, exceeds said "predetermined value", the flaps flex (see FIG. 2B) to enable the fluid to be dispensed.

In conclusion it should be noted that the valve flange 2A has dimensions greater than the seat 7 such that even if the valve becomes released from the undercut, it cannot escape from the container.

It should again be noted that the cap comprises the cover 4, which when in the lowered position (FIG. 8) cooperates with the valve flaps by pressing on at least one of them, such as to prevent valve opening, independently of the pressure present in the container.

Advantageously there is also a further seal provided between the cover 4 and the dispensing port, which even further ensures the impossibility of substance leakage when the cover is lowered.

It must be emphasized that the valve in question is particularly advantageous compared with those traditional valves which are cut after moulding.

This is because such valves present flaps which close the dispensing port by abutting against each other. These consequently form a perfect seal and indeed prevent fluid exit, but also prevent air entering in any situation. This generates a constant vacuum in the container, making it uncomfortable to use. In fact it must be almost totally "squeezed" to enable the entire product to be used.

A further drawback which is overcome by the present valve is linked to the possible presence of deposits or substance residues therein. In traditional valves the "sticky" effect of a dry product remained trapped between two abutting flaps is considerable. In fact it is often necessary to exert a much higher pressure than the "design" pressure to enable the substance to be dispensed. This is due to the need to overcome the gluing force between two abutting surfaces pressed together by the elasticity and shape of the valve material. In the current solution the flaps are not urged to rest abuttingly against each other, but instead the seal is given by the flexural rigidity imposed by the flap shape. Hence even if the substance should dry between one flap and another, a slight pressure would be sufficient to remove this block, the flaps being able to mutually move transversely (rising or lowering).

A preferred embodiment of the invention has been described, however others can be conceived by utilizing the same inventive concept.

The invention claimed is:

1. A dispensing cap with automatic valve for containers for transporting and dispensing liquid or creamy substances, comprising means for sealed fixing the cap to a container neck, and a dispensing port opening towards the outside of the cap and associated with said automatic valve, the valve comprising a body formed of soft plastic material and means for fixing the valve to the cap, and at least one first and one second flexible flap able to assume a closed position in which, when the valve is subjected to a pressure from inside the container less than a determined value, the flaps, by resting on each other, form a seal to prevent the substance in the container from escaping, and an open position in which said flaps, when the pressure from inside the container acting on said valve exceeds said predetermined value, flex to enable fluid dispensing, said first and said second flap are formed in at least two different planes, such that when the pressure inside the container equals the external pressure they assume a rest position in which between the lower surface of the first flap and the upper surface of the second flap at least one slit is present, enabling air to pass.

2. A cap as claimed in claim 1, when in the rest position, the lower surface of the first flap is spaced from the upper surface of the second flap by a distance between 0.05 and 1.5 mm.

3. A cap as claimed in claim 1, wherein said flaps have a thickness between 0.2 mm and 3 mm.

4. A cap as claimed in claim 1, wherein said pressure of predetermined value is a function of the flap thickness and of the material from which the valve is formed.

5. A cap as claimed in claim 1, wherein when in the rest position, the lower surface of the first flap is substantially in contact with the upper surface of the second, but without forming an airtight seal.

6. A cap as claimed in claim 1, wherein two first and two second flaps are present.

7. A cap as claimed in claim 1, wherein, preceding in the clockwise direction, the valve is formed from a first flap, a second flap, a further first flap, and a further second flap, each of the respective first and second flaps being mutually offset by 90°.

8. A cap as claimed in claim 6, wherein the flaps assume the shape of a circular sector.

9. A cap as claimed in claim 1, wherein each of said flaps is dimensioned to be seen to be slightly superposed on the adjacent flap when viewed in plan.

10. A cap as claimed in claim 1, wherein the means for fixing the valve to the cap comprise an undercut connection.

11. A cap as claimed in claim 1, wherein said valve is housed in a seat provided in the cap, and presents a flange of greater dimensions than the seat such that even if the valve becomes released from the undercut, it cannot escape from the container.

12. A cap as claimed in claim 1, wherein said valve is formed from a member of the group consisting of thermoplastic rubber, styrene ethylene butadiene styrene, linear low density polyethylene and silicone.

13. A cap as claimed in claim 1, comprising a cover movable between a first position in which it does not interfere with said valve, and a second position in which said cover presses on at least one of said flaps such as to prevent it from opening and hence ensure a seal.

14. A cap as claimed in claim 1, when in the rest position, the lower surface of the first flap is spaced from the upper surface of the second flap by a distance between 0.05 and 0.15 mm.

15. A cap as claimed in claim 1, wherein said flaps have a thickness between 0.2 mm and 0.4 mm.

* * * * *